US005398934A

United States Patent [19]

Soong

[11] Patent Number: 5,398,934

[45] Date of Patent: Mar. 21, 1995

[54] GOLF CLUB AND GRIP THEREFOR

[76] Inventor: Tsai C. Soong, 1839 Jackson Rd., Penfield, N.Y. 14625

[21] Appl. No.: 134,888

[22] Filed: Oct. 13, 1993

[51] Int. Cl.[6] ..... A63B 53/14

[52] U.S. Cl. ..... 273/81 R; 273/80 B

[58] Field of Search ..... 273/81 R, 81.2, 81.3, 273/81.4, 81.5, 81.6, 81 A, 81 B, 81 C, 81 D, 80 B, 193 B

[56] References Cited

U.S. PATENT DOCUMENTS 5,054,781 10/1991 Soong ..... 273/80 B 5,160,139 11/1992 Soong ..... 273/81 R

*Primary Examiner*—George J. Marlo

*Attorney, Agent, or Firm*—Bernard A. Chiama

[57] ABSTRACT

In a golf club having a shaft with one end for the hand to hold and the other end leads to a head, the shaft is equipped with a sleeve unit comprising a rigid sleeve member and an elastic media element, covering the shaft end, wherein the inner surface of the sleeve member and the outer surface of the shaft is at least partially filled with elastic media element material. Said inner surface of the sleeve element is preferably curved and the sleeve member and the elastic media element may extend into the hollow end of the shaft for improved control. Means is provided in the sleeve unit so that the rocking movement between the sleeve member and the shaft is made different in the plane of swing and in the plane normal to the plane of swing. The sleeve unit may be detachable and reattachable to an existing golf club as a stand-alone replacement unit.

20 Claims, 3 Drawing Sheets

GOLF CLUB AND GRIP THEREFOR

INVENTION BACKGROUND

The handle of a golf club is designed to provide a firm grip by the hand to hold the club firmly and to apply force to manipulate the equipment for desired movement. For the golf cub, not like a tennis racket, an immediate and forceful response is not as desirable as a controlled response which follows behind the movement of the hand in a deliberate and measured pace, taking advantage of the swinging inertia to metering out the impact gradually, just enough to nudge the ball forward gently and fall down the hole, not too haste to force the ball out over the other side. Experience tells the golfer how he is to hold and drive the golf club. However, the force applied to the handle by a human hand, especially with two hands and ten fingers, is not an exact science. Nerves and muscles of a human body are subjected to many physical factors not controllable by the player. That is why golfers, even pros, will always have "good" days and "bad" days. The problem here is that the conventional handle allowed all fingers to handle the club individually and directly. Suppose the handle design is changed, such that the fingers are not to grip the shaft directly. Suppose the two hands are forcing the shaft through a rigid sleeve, and the sleeve drives the shaft indirectly through a deformable media, such as rubber. In this way, the sleeve and the shaft are separated by an elastic media. The rigid sleeve averaged the outputs from all the fingers and transmits a collective lump sum drive force to the club shaft. Chances of random inputs are minimized.

Prior art has a handle comprising a rigid sleeve connecting to the shaft elastically which reduces the dependency and improves the compliance. However, the rotational axi-symmetric sleeve unit may amplify the undesirable out-of-plane bending of the shaft due to the eccentricity of the head of the golf club. The invention is to improve the prior art through redesign of the sleeve so that the performance of the golf club with the sleeved handle is further enhanced.

DESCRIPTIONS OF THE DRAWINGS

Figures only depict some of the preferred embodiments of the invention among all practically possible and desirable arrangements. The figures are:

SUMMARY OF INVENTION AND PREFERRED EMBODIMENTS

Figure 1:
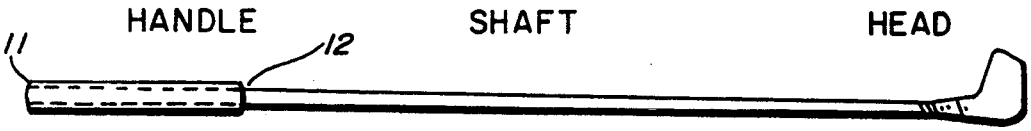
PRIOR ART FIG. 1
FIG. 1 shows a golf club.

FIG. 1 shows a typical golf club where what is called a handle is the end portion of the shaft, bounded by a shaft end 11 and a head end 12, wrapped by a rubber grip, the head end 12 of the shaft leads to the rest of the shaft and the head of the golf club.

Figure 2:
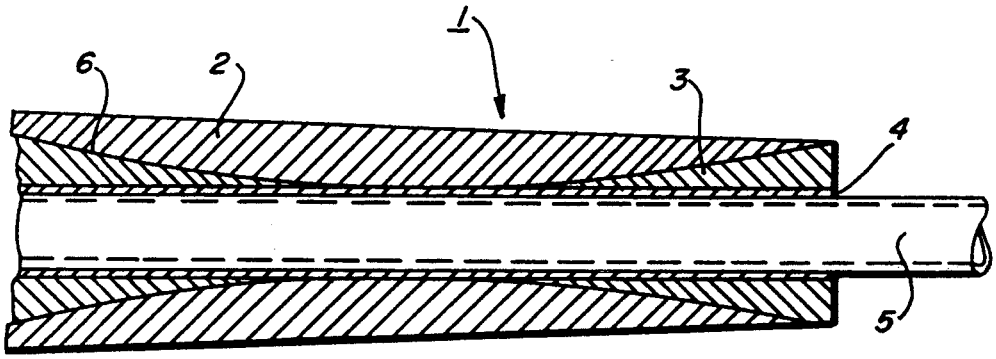
PRIOR ART FIG. 2
FIG. 2 shows a prior art sleeve unit.
Figure 3:
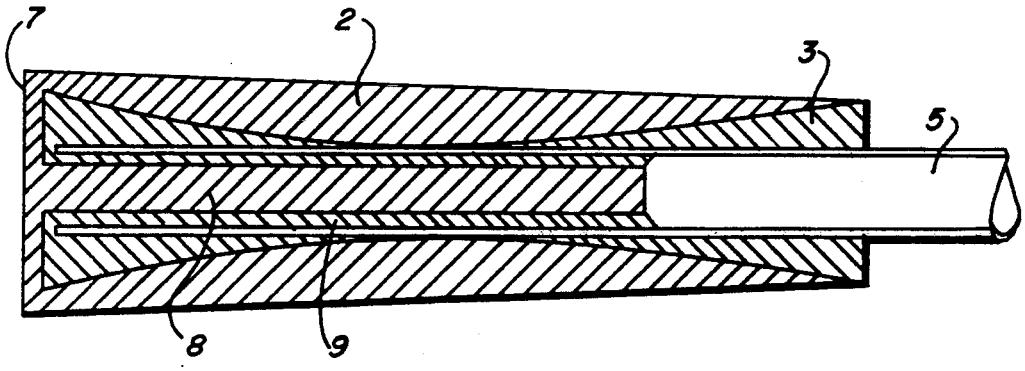
PRIOR ART FIG. 3
FIG. 3 shows another prior art sleeve unit.

FIGS. 2 and 3 show a prior art sleeve unit installed at the end portion of the shaft replacing the conventional rubber grip. It is described in U.S. Pat. No. 5,160,139 by Soong. The sleeve unit 1 is composed of a rigid sleeve member 2 whose outer surface may have a rubber grip to increase friction for the hand of a user to hold and its inner surface 6 is generally curved in a convex manner. The sleeve member is rigid, made of hard material, such as metal, reinforced graphite fiber, etc. In between the sleeve's inner surface and the outer surface of the shaft 5, there is a soft, deformable media element 3, at least partially filled the space in between. The material of the media element may be rubber-like synthetics, or other soft, elastic materials. There is no rigid structural connection between the sleeve member 2 and the shaft 5. The apex of the curved convex inner surface of 2 is located at a point between the two ends of the sleeve unit. The device enables the handle, which is now the sleeve unit with the shaft inside, to have a controlled longitudinal rocking movement between the sleeve unit and the shaft inside when the user swings the handle. Since both the sleeve member and the shaft are rigid bodies with the soft media element separating them and transmitting the internal forces between them during swing, the distribution of the media element inside and along the sleeve member will influence the longitudinal rocking movement which controls the head motion of the golf club following the swing of the handle, in a positively controlled manner, called controlled compliance. This means the user can take advantage of the momentum build-up and metering out the required drive force according to his or her style in a controlled, mechanical, regulated manner not possible if the player is merely holding the conventional golf club through a rubber grip.

FIG. 3 shows the extended sleeve member 8 and the media element 9 into the interior space of the shaft through the end cap 7. This arrangement provides more positive response of the longitudinal rocking movement between the sleeve member and the shaft inside.

However, attention is to be paid on the possible rocking movement between the sleeve member and the shaft in the plane normal to the plane of swing of the golf club due to the eccentric manner the head is installed on the shaft which is common in conventional golf clubs.

Figure 4:
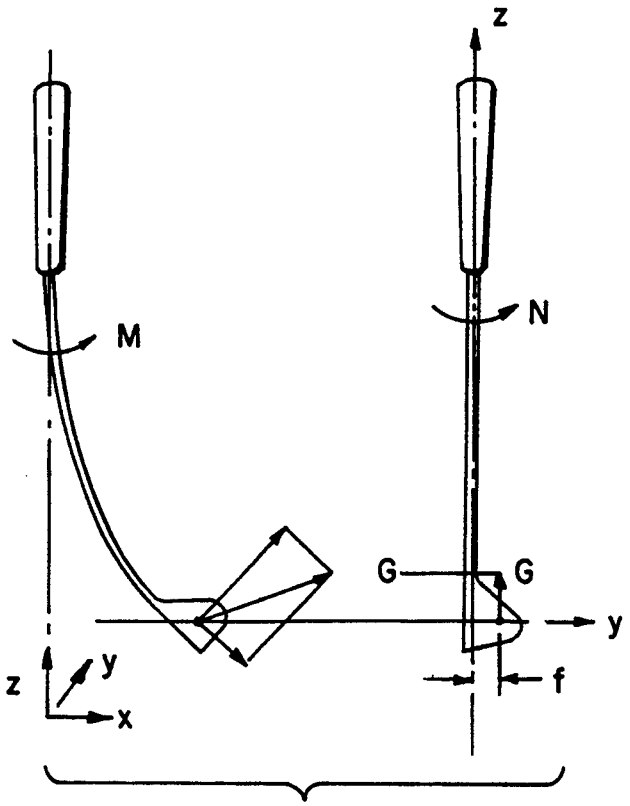
FIG. 4 shows force acting on a swinging golf club with an eccentric head.

The sketch in FIG. 4 shows the golf club is swung in the z-x plane, called the plane of swing. The resultant inertia force G from the head creates a bending moment M on the handle in the z-x plane which bends the shaft before the head hits the ball. It is to be noted that the head should hit the ball squarely on its hitting face and the head should move in a plane parallel to the plane of swing when it hits the ball. However, due to the eccentricity f of the head, the inertia force also has a component bending moment N in the z-y plane, perpendicular to the plane of swing. The head of a typical golf club is 240 g, and a two to four centimeter eccentricity, common in golf clubs, could produce considerable bending to throw the head out of the swing plane and rotate the orientation of the hitting face of the head into a wrong direction. Numerous devices appeared in prior art tried to improve this distortion problem.

This problem also exists in the golf club employing the U.S. Pat. No. 5,160,139 by Soong.

The present invention is an improvement on Soong's art. In general, means is provided to influence the function of the device, so that the longitudinal rocking movement, or say the controlled compliance, could be different in the plane of swing and in the plane normal to the plane of swing; making it harder or even impossible to move in one direction but moves freely in the other direction. The cross section of the sleeve member is no longer axi-symmetric all the way along the axis. The discovery of the need for it and the arrangement to achieve improvement is the invention.

Figure 5:
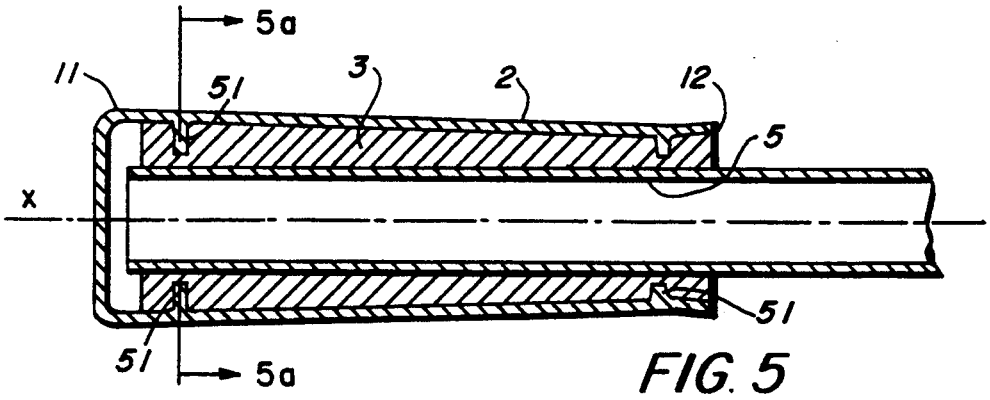
FIG. 5 shows an embodiment of a modified sleeve unit installed on a shaft.
Figure 5A:
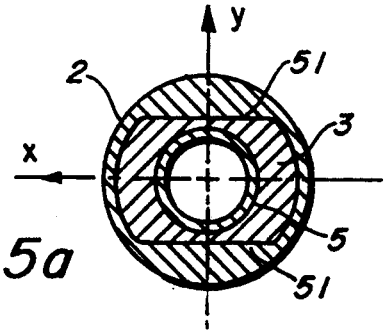
Figure 6:
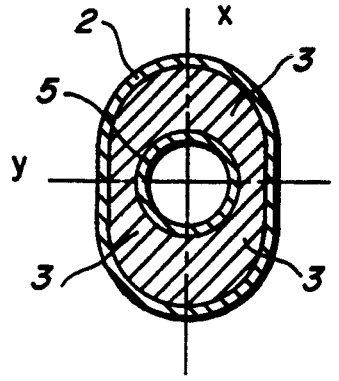
FIG. 6 shows a non-circular cross section.
Figure 7:
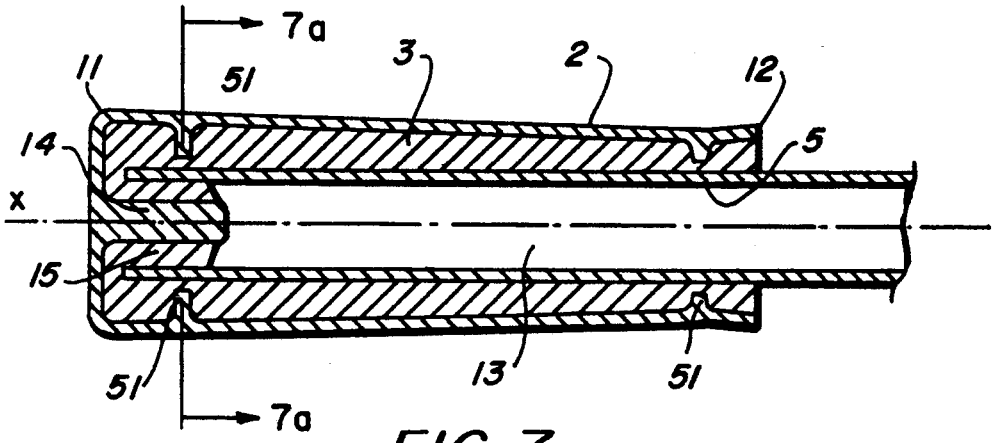
FIG. 7 shows another embodiment of the present invention.
Figure 7A:
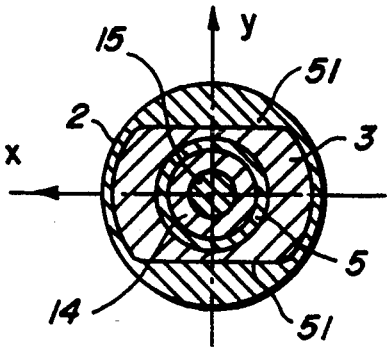

There could be numerous ways to do that. For example, FIG. 5 shows an embodiment in which a hard device, in the form of a pair of lugs 51, is placed at opposite sides of the sleeve member and extending inwardly for some depth. Section 3—3 shows the non-axisymmetric arrangement. Similar lugs may be repeated elsewhere along the axis of the sleeve member. The y-axis in FIG. 5 is the same y-axis in FIG. 4. Consequently, the rocking movement in the plane of swing along the x-axis direction, has no restriction imposed by the presence of the lugs whereas the movement in the y-axis direction is restricted, or even completely eliminated by the lugs. Then the erroneous bending moment component which is caused by the eccentricity of the head will not bend the shaft and distort the hitting face angle of the head during swing. Similar non-axisymmetric arrangement can be made by having the cross section of the sleeve member becoming non-circular along some length of the sleeve member as shown in FIG. 6. FIG. 7 shows a similar improvement made for the configuration of FIG. 3 wherein the sleeve member and the media element extend into the hollow space inside the shaft. Section 5—15 shows the section at the lugs. The means suggested here as examples is relatively simple, but the need for it in the prior art requires theoretical and practical understanding of the art, and the resulting improvement obtained is crucial to the function of the golf club.

DETACHABLE AND REATTACHABLE SLEEVE UNIT

The modified sleeve unit as shown in FIGS. 5 and 7, minus the shaft part 5 may be made and installed as a detachable and reattachable, stand-alone accessory or replacement unit for a golf club, to be adapted on existing, new or used, golf clubs.

This unit may be slipped onto an existing golf club with its conventional rubber grip removed. The cylindrical inner opening in the media element 3 may be slipped over the end portion of the exposed shaft with no additional adaptive means ever needed. If the inner diameter of the media element 3 is made a little smaller than the outer diameter of the shaft 5, the friction will be enough to prevent the sleeve unit from loosing up and disengaged from the handle. If more positive preventive arrangement is needed, mechanical or chemical means, such as medium strength bonding substance, can be applied onto the surface of the exposed shaft assembly.

Various other modifications that would occur to a skilled workman in the field based on principles shown in the invention may be assumed to come within the scope of the following claims. For example, the inner surface of the sleeve member 2 may be curved so as to be convex toward the shaft 5 with the apex thereof between the ends of the sleeve member, but preferably in the central portion thereof.

What is claimed is:

1. In a golf club having a shaft with a handle portion, from a first shaft end to a second shaft end leading to a head adapted to engage a ball, for gripping by the hands of a user during playing use of the golf club, the improvemenmt comprising:

a sleeve unit arranged around said shaft and adapted for manual gripping by the user, said sleeve unit including a rigid sleeve member arranged for encircling the shaft, and a deformable media element filling at least partially the space between said sleeve member and the shaft, said sleeve member and said media element being adapted for producing relative longitudinal rocking movement between said sleeve member and the shaft upon manipulation of the handle during playing use of the golf club, and means for permitting said rocking movement in the plane of the swinging of the golf club to be different from the rocking movement in the plane normal to the plane of the swinging of the golf club.

2. The golf club as defined in claim 1 wherein the sleeve member is structurally separated relative to the surface of the shaft.

3. The golf club as defined in claim 1 wherein the inner surface of the sleeve member has a generally convex shape with the apex thereof being positioned between the ends of said sleeve member.

4. The golf club as defined in claim 1 wherein the inner surface of the sleeve member bas a generally flat shape and being closer to the shaft at one end than at the other end.

5. The golf club as defined in claim 1 wherein said means permits said rocking movement of the handle in the plane of the swinging of the golf club and reduces the rocking movement in the plane normal to the plane of the swinging of the golf club.

6. The golf club as defined in claim 1 wherein the sleeve unit is detachably coupled to the shaft so as to permit removal from and attachment to the shaft.

7. The golf club as defined in claim 1 including means to facilitate removal and attachment of the sleeve unit to the shaft.

8. The golf culb as defined in claim 1 wherein said means includes at least a pair of opposed, inwardly projecting members disposed at opposite sides of the sleeve member.

9. The golf club as defined in claim 1 wherein said means is produced by said sleeve member having a non-circular cross section for at least a portion of its length along the axis of said sleeve member.

10. A sleeve unit adapted for slipping over the end of a golf club shaft opposite the end holding a golf head therefor and having an axis along its length, comprising:

a rigid sleeve member having a surface for gripping by a user, an elastic media element being at least partially encircled by said sleeve member, said sleeve member and said media element being adapted for producing relative rocking movement between said sleeve member and the shaft, and means for permitting said rocking movement in the plane of the swinging of the golf club to be different from the movement in the plane normal to the plane of the swinging of the golf club.

11. The sleeve unit as defined in claim 10 wherein said means includes at least a pair of opposed, inwardly projecting members disposed at opposite sides of said sleeve member.

12. The sleeve unit as defined in claim 10 wherein said means is produced by said sleeve member having a non-circular cross section for at least a portion of its length along the axis of said sleeve member.

13. In a golf club having a shaft with a handle portion, from a first shaft end which is at least partially hollow, to a second shaft end leading to a head adapted to engage a ball, for gripping by the hands of a user during playing use of the golf club, the improvement comprising a sleeve unit arranged around said shaft and adapted for manual gripping by the user, said sleeve unit including a rigid sleeve member arranged for encircling the shaft, and a deformable media element filling at least partially the space between said sleeve member and the shaft, said sleeve member and said media element being adapted for producing relative longitudinal rocking movement between said sleeve member and the shaft upon manipulation of the handle during playing use of the golf club, and means for permitting said rocking movement in the plane of the swinging of the golf club to be different from movement in the plane normal to the plane of the swinging of the golf club.

14. The golf club as defined in claim 13 wherein said means includes at least a pair of opposed, inwardly extending members disposed at opposite sides of said sleeve member.

15. The golf club as defined in claim 13 wherein said means includes having said sleeve member non-circular in cross section for at least a portion of its length along the axis of said sleeve member.

16. The golf club as defined in claim 13 wherein the sleeve member is structurally separated from the shaft thereby permitting the removal from and attachment of the sleeve unit relative to the shaft.

17. A sleeve unit arranged for detachable and reattachable relationship to the shaft of a golf club, comprising, a rigid sleeve memeber at least partially hollow at one end thereof and adapted to receive one end of the shaft, said sleeve member including a hand-applying gripping surface and an end cap, said cap having an extension rigidly attached thereto at its center and extending toward and into said hollow end of said sleeve member, an elastic media element at least partially enclosed by said sleeve member, filling at least partially the space inside said sleeve member, and said sleeve member and media element being adapted for producing relative longitudinal movement between said sleeve member and the shaft, and means for permitting said rocking movement in the plane of the swinging of the golf club to be different from movement in the plane normal to the plane of swinging of the golf club.

18. The sleeve unit as defined in claim 17 wherein said means includes at least a pair of opposed, inwardly extending members disposed at opposite sides of said sleeve member.

19. The sleeve unit as defined in claim 17 wherein said means is produced by said sleeve member having a non-circular cross section for at least a portion of its length along the axis of said sleeve member.

20. The sleeve unit as defined in claim 17 wherein said sleeve member of said sleeve unit is structurally separated from the outer surface of the shaft, thereby permitting the removal from and attachment of the sleeve unit relative to the shaft.

* * * * *